US005718495A

United States Patent [19]

Lee

[11] Patent Number: 5,718,495

[45] Date of Patent: Feb. 17, 1998

[54] WASTE BIN HAVING FINGER PRESSURE MEMBER

[76] Inventor: Bok Woo Lee, 3 Floor, 6 Sukchin-dong, Song-ku, Seoul, Rep. of Korea

[21] Appl. No.: 756,338

[22] Filed: Nov. 26, 1996

[51] Int. Cl.[6] ..... A47B 88/00

[52] U.S. Cl. ..... 312/319.1; 312/211; 297/423.41; 601/118; 601/134

[58] Field of Search ..... 297/423.41; 601/22, 601/28, 115, 118, 122, 134, 135, 136; 312/319.1, 235.1, 235.2, 298, 301, 330.1, 211

[56] References Cited

U.S. PATENT DOCUMENTS

| | | | |
|---|---|---|---|
| 1,849,809 | 3/1932 | Showers | 312/319.1 X |
| 2,887,151 | 5/1959 | Springer | 297/423.41 X |
| 3,592,521 | 7/1971 | Cox | 312/319.1 X |
| 3,636,946 | 1/1972 | Hardy | 601/28 |
| 5,056,507 | 10/1991 | Yum | 601/136 |
| 5,139,321 | 8/1992 | Beandsley | 312/301 X |
| 5,527,247 | 6/1996 | Archambault | 601/122 X |
| 5,549,375 | 8/1996 | Pagliaccio | 312/319.1 X |

FOREIGN PATENT DOCUMENTS

| | | | |
|---|---|---|---|
| 5285190 | 11/1993 | Japan | 601/22 |
| 1635994 | 3/1991 | U.S.S.R. | 601/28 |
| 2243083 | 10/1991 | United Kingdom | 601/134 |

*Primary Examiner*—Peter M. Cuomo
*Assistant Examiner*—James O. Hansen
*Attorney, Agent, or Firm*—Staas & Halsey

[57] ABSTRACT

A waste bin, having finger pressure members, which may be positioned under a table, with a finger pressure effect and having at least one drawer type waste receiving bin, includes a body plate having finger pressure members with multiple finger pressure protrusions formed on an inclined crook plate with a curved surface, with two finger pressure rolls; a guide rail formed on each of the left and right sides of insertion openings formed on a bottom surface of the body plate, and an insertion groove formed on a front side of the side protrusions; guide grooves having a trail roller which is directed by guide rails, and formed on both outer sides of the receiving bin; stoppers formed on the receiving bins; resilient means fixed on the rear side of each of the insertion openings; and two drawer type dust receiving bins adapted to be inserted to the insertion openings.

3 Claims, 2 Drawing Sheets

WASTE BIN HAVING FINGER PRESSURE MEMBER

TECHNICAL FIELD

The present invention relates to a waste or dust bin assembly, and particularly, to a waste bin having finger pressure means which may be positioned under the table, with a finger pressure effect and drawer type waste receiving bins.

BACKGROUND ART

Generally, rubbish, dirt, etc. are collected in a cylindrical-shaped or square-shaped waste basket, trash can or dust bin, and a space for such wastebaskets, trash cans or dust bins is needed.

The recycle waste and disuse dirt requires multiple dust bins to collect the waste, respectively. Thus, large spaces are required to serve as a reservoir for the waste.

The finger pressure effect on the sole of the foot is good for the health.

Thus, there is required a waste bin, having finger pressure members which may be positioned under a table, with a finger pressure effect and at least one drawer type waste receiving bin, that may be positioned in a small space or room.

SUMMARY OF THE INVENTION

It is, therefore, one object of the present invention to provide an improved dust bin having a finger pressure plate and a rod which may be positioned under the table, and which includes a finger pressure therapy member and two or more drawer type dust receiving bins.

The present invention provides a dust bin having a finger pressure plate and a finger pressure rod which may be positioned under a table and which includes multiple finger pressure protrusions formed on an inclined plate with a curved surface and rods with one or more finger pressure rolls and two or more drawer type dust receiving bins.

The drawer type dust receiving bins with a resilient means are provided on the lower part of the finger pressure plate.

In accordance with the present invention, there is provided an improved waste bin, having a finger pressure member which may be positioned under the table with a finger pressure effect and a drawer type waste receiving bin, which comprises:

a body plate having finger pressure members with multiple finger pressure protrusions formed on an inclined crook plate and a curved surface, with two finger pressure rolls;

a guide rail formed on the left and right sides of insertion openings on the bottom of the body plate, and an insertion groove formed on the front side of the guide protrusions;

guide grooves having a trail roller, which is directed by the guide protrusions formed on both outer sides of the receiving bin;

stoppers formed on the receiving bin;

resilient means fixed on the rear side of the insertion opening;

two drawer type dust receiving bins inserted in the insertion opening with the resilient means provided on the lower part of the pressure plate.

A waste bin having finger pressure further comprises:

a spring as one of the resilient means provided on the rear inner side of the receiving bins;

the spring is inserted to a fixing means formed on the rear inner side of the receiving bins;

a cover with an insertion groove is mounted in front of the fixing means;

a pressing bar inserted in an insertion groove and placed on the rear side of the receiving bins;

alternatively, an electro-magnetic means as another of the resilient means is fixed on the rear inside of the insertion opening.

a metallic plate is joined in front of the electro-magnetic means and a magnet is fixed on the rear side of the receiving bins, and, a switch is connected to the electro-magnetic means.

Additional objects and features of the present invention will be apparent from the following description, in which reference is made to the accompanying drawings.

DETAILED DESCRIPTION OF THE PREFERRED EMBODIMENT

Figure 1:
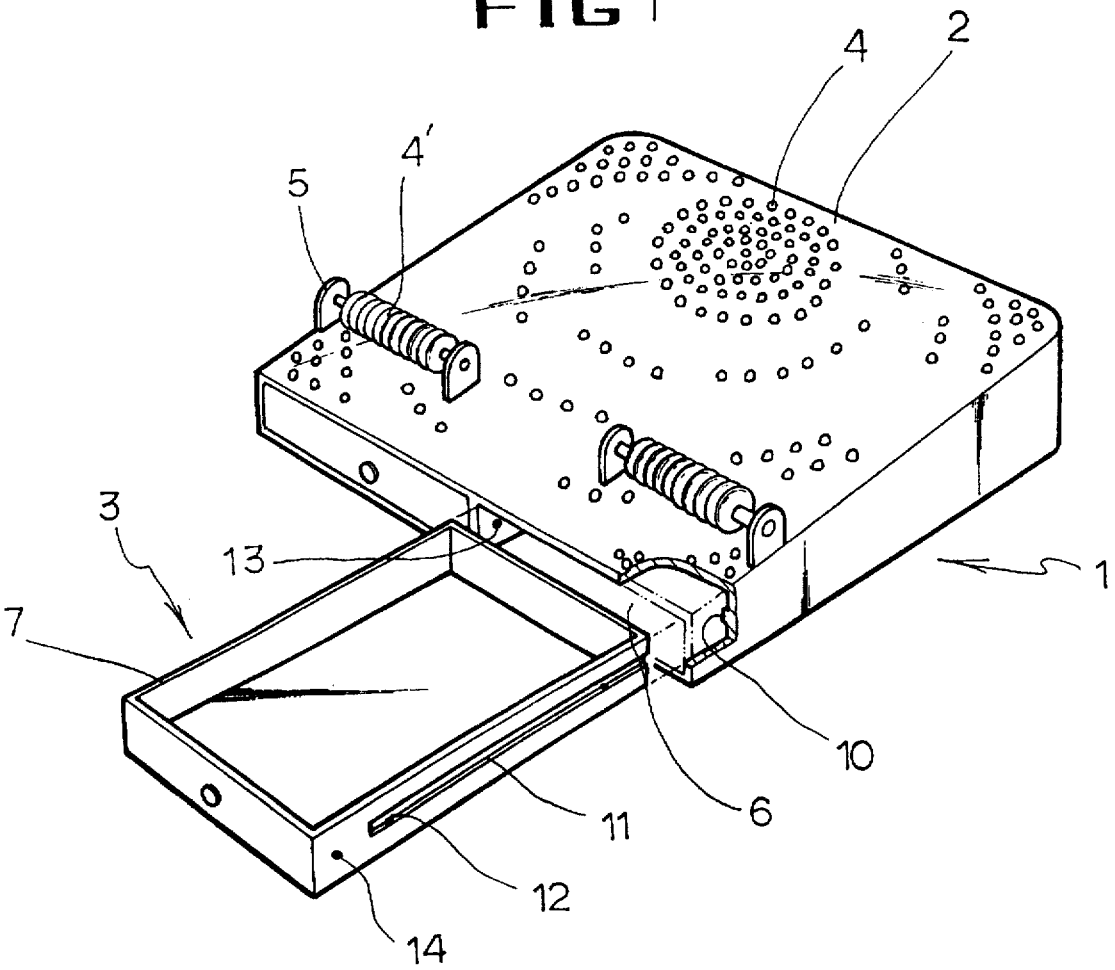
FIG. 1 is an exploded perspective view of a preferred embodiment of the invention.
Figure 2:
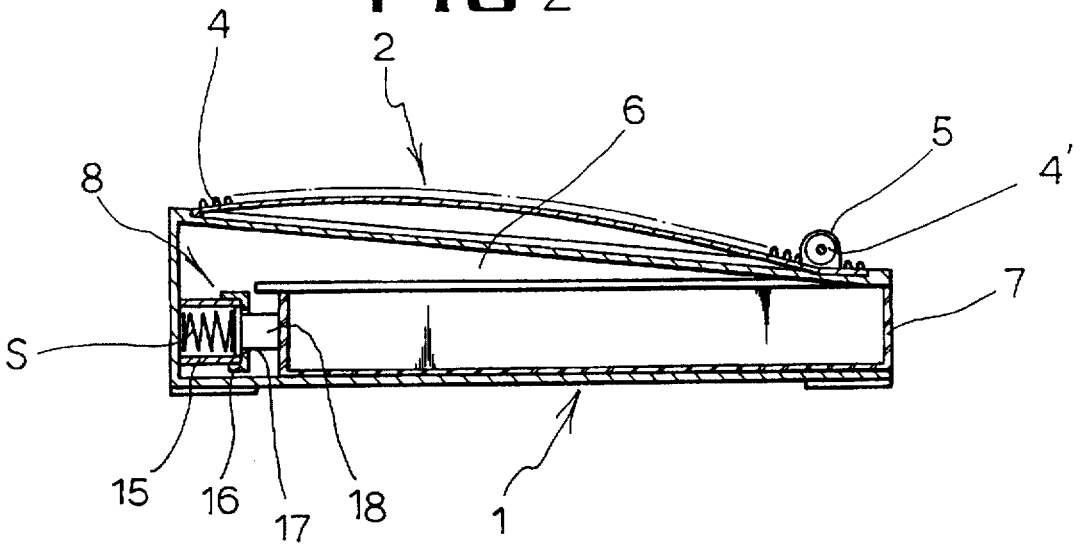
FIG. 2 is an exploded sectional view of a joined state of the invention.

Referring now to the figures of the drawings, and in particular to FIG. 1, a body plate 1 having finger pressure members 2 with the multiple finger pressure protrusions formed on an inclined crook plate with a curved surface, with two finger pressure rolls 4';

a guide rail 10 formed on the left and right sides of the insertion openings 6 on the bottom of the body plate 1, and an insertion groove 13 formed on the front side of the guide rails 10;

guide grooves 11 having a trail roller which is directed by the guide rails 10, are formed on both outer sides of the receiving bin 7;

stopper 14 is formed on each of the receiving bins 7;

the spring S as one type of resilient means, fixed on the rear side of the insertion opening 6;

two drawer type dust receiving bins 7 are inserted to the insertion openings 6 with a resilient means 8 being provided on the lower part of the finger pressure plate.

Figure 3:
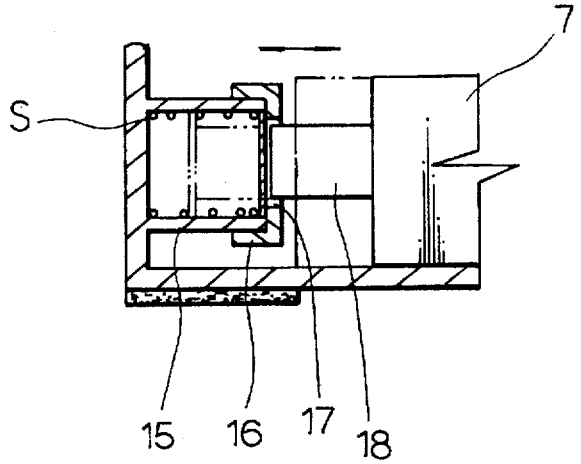
FIG. 3 is an elevational section view of the S portion of FIG. 2.

In FIG. 3, the spring is one of the resilient means 8 provided on the rear inner side of receiving bins 7;

the spring S is inserted to a fixing means 15 formed on the rear inner side of receiving bins 7;

a cover 16 with an insertion groove 17 is mounted in front of the fixing means 15;

a pressing bar 18 is inserted in the insertion groove 17 and placed in the rear side of the receiving bins 7.

Figure 4:
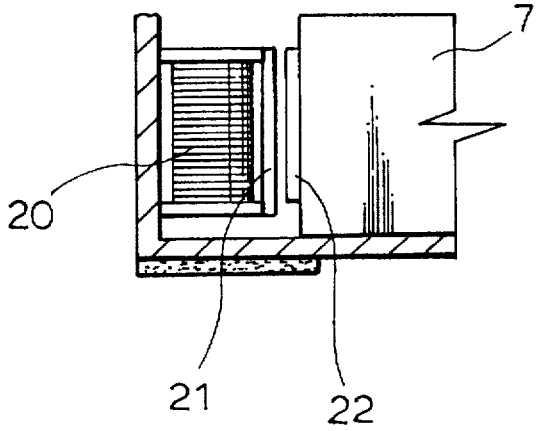
FIG. 4 is a sectional view of another preferred embodiment according to the invention.

In FIG. 4, another preferred embodiment according to the invention is described where another type of resilient means 8 is comprised of;

an electro-magnetic means 20 fixed on the rear inside of insertion opening 6;

a metallic plate 21 joined in front of the electro-magnetic means 20 and a magnet 22 is fixed on the rear side of the receiving bins 7; and, a switch (not shown) may be connected to the electro-magnetic means 20.

Figure 5:
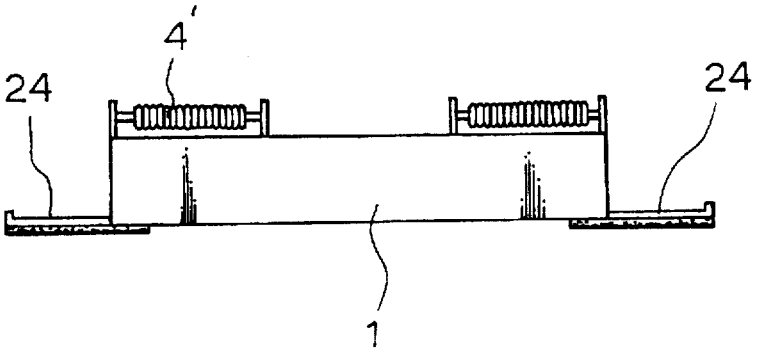
FIG. 5 is a front side view of the other preferred embodiment of the invention.

FIG. 5 is a front side view of the other preferred embodiment of the invention, the body plate having finger pressure members 2 with both side support plates 24 formed on both sides of the body plate 1, thus the shoes may be placed on both side support plates 24, and the sole of each foot lies on the finger pressure members 2.

What is claimed is:

1. A waste bin, having finger pressure members, which is adapted to be positioned under a table, with a finger pressure effect and a drawer type waste receiving bin, comprising:

a body plate having finger pressure members with multiple finger pressure protrusions formed on an inclined crook plate having a curved surface, with two finger pressure rolls;

at least one insertion opening formed on a bottom portion of the body plate, a guide rail formed on left and right sides of the insertion opening with an insertion groove formed on a front side of the guide rails;

at least one drawer type dust receiving bin adapted to be inserted into the insertion opening, guide grooves formed on both outer sides of the receiving bin with each guide groove having a trail roller, which is directed by the guide rails;

and resilient means fixed on the body plate and positioned opposite the insertion opening.

2. A waste bin having finger pressure members as claimed in claim 1, wherein:

the resilient means is a spring;

the spring is inserted into a fixing means formed on an inner rear surface of the body plate;

a cover with an insertion groove is mounted in front of the fixing means; and a pressing bar inserted in said insertion groove and disposed on a rear inner side of said receiving bin.

3. A waste bin having finger pressure members as claimed in claim 1, wherein:

an electro-magnetic means is fixed on the body plate and positioned opposite the insertion openings;

a metallic plate is joined to a front of the electro-magnetic means and a magnet is fixed on a rear side of the receiving bin; and a switch is connected to the electro-magnetic means.

* * * * *